US005307937A

United States Patent [19]

Hutwelker

[11] Patent Number: 5,307,937

[45] Date of Patent: May 3, 1994

[54] HIGH THROUGHPUT FLOTATION COLUMN PROCESS

[75] Inventor: Joel F. Hutwelker, Asheville, N.C.

[73] Assignee: North Carolina State University, Raleigh, N.C.

[21] Appl. No.: 19,153

[22] Filed: Feb. 17, 1993

[51] Int. Cl.[5] ..... B03B 13/00; B03D 1/02; B03D 1/24

[52] U.S. Cl. ..... 209/164; 209/1; 209/166; 209/170

[58] Field of Search ..... 209/164, 166–170, 209/902

[56] References Cited

U.S. PATENT DOCUMENTS

| | | | |
|---|---|---|---|
| 2,753,045 | 7/1956 | Hollingsworth . | |
| 2,758,714 | 8/1956 | Hollingsworth . | |
| 2,783,884 | 3/1957 | Schaub . | |
| 3,246,749 | 4/1966 | Moser . | |
| 3,250,394 | 5/1966 | Clark . | |
| 3,271,293 | 9/1966 | Clark . | |
| 3,298,519 | 1/1967 | Hollingsworth . | |
| 3,322,272 | 5/1967 | Evans . | |
| 3,371,779 | 3/1968 | Hollingsworth | 209/170 |
| 3,642,129 | 2/1972 | McDaniel . | |
| 3,834,529 | 9/1974 | Hart . | |
| 3,860,513 | 1/1975 | Hart et al. | 209/1 |
| 3,883,421 | 5/1975 | Cutting et al. | 209/1 |
| 4,162,966 | 7/1979 | Finch | 209/166 |
| 4,222,861 | 9/1980 | Finch | 209/166 |
| 4,222,862 | 9/1980 | Finch | 209/166 |
| 4,253,942 | 3/1981 | Gaumann . | |
| 4,287,054 | 9/1981 | Hollingsworth | 209/170 |
| 4,431,531 | 2/1984 | Hollingsworth | 209/170 |
| 4,478,710 | 10/1984 | Smucker | 209/170 |
| 4,552,651 | 11/1985 | Sandbrook et al. | 209/1 |
| 4,559,134 | 12/1985 | Wasson | 209/166 |
| 4,732,667 | 3/1988 | Hellsten et al. | 209/166 |
| 4,772,382 | 9/1988 | Bulatovic | 209/166 |
| 4,797,550 | 1/1989 | Nelson et al. | 250/227 |
| 4,804,460 | 2/1989 | Moys | 209/170 |
| 4,822,493 | 4/1989 | Barbery | 209/170 |
| 4,851,036 | 7/1989 | Anthes | 209/170 |
| 4,892,648 | 1/1990 | Kulkarni | 209/164 |
| 4,971,731 | 11/1990 | Zipperian | 209/170 |
| 5,032,257 | 7/1991 | Kulkarni | 209/168 |
| 5,078,921 | 1/1992 | Zipperian | 209/170 |
| 5,106,489 | 4/1992 | Schmidt et al. | 209/166 |
| 5,116,487 | 5/1992 | Parekh et al. | 209/164 |
| 5,122,261 | 6/1992 | Hollingsworth . | |

FOREIGN PATENT DOCUMENTS

| | | | |
|---|---|---|---|
| 680576 | 2/1964 | Canada . | |
| 694547 | 9/1964 | Canada | 361/2 |

OTHER PUBLICATIONS

Soto, H. and Barbery, G.; "Flotation of Coarse Particles in a Counter-Current Column Cell"-Minerals & Metallurgical Processing, vol. 8, No. 1, 1991 pp. 16–21.

*Primary Examiner*—Thomas M. Lithgow
*Attorney, Agent, or Firm*—Richard E. Jenkins

[57] ABSTRACT

A high efficiency method for the recovery of relatively coarse constituent utilizing a flotation column is provided. The method broadly includes the steps of (1) establishing and maintaining a net upward flow of water (negative bias) through the upper portion of the flotation column which is maintained below a predetermined critical limit; (2) establishing and maintaining an upwardly moving stream of diffuse air which is introduced at the lower portion of the flotation column and which has a superficial air velocity between about 0.5 and 2.0 cm/sec.; (3) introducing a feed stream comprising a slurry of the ore into the upper portion of the flotation column wherein the mineral particles therein substantially range between about 20 mesh (840 microns) and about 325 mesh (44 microns) in size; (4) establishing and maintaining the percent solids in the flotation column between about 35 and 50%; (5) establishing and maintaining column throughput of the slurry between 1.8 and 4.0 tons/hour/sq. ft.; and (6) recovering the desired mineral particles from the upper portion of the flotation column.

6 Claims, 9 Drawing Sheets

HIGH THROUGHPUT FLOTATION COLUMN PROCESS

DESCRIPTION

1. Technical Field

The present invention relates to an improved flotation column process for the recovery of selected mineral particles from an ore, and more particularly to a novel high throughput, high solids flotation column process for recovering selected coarse mineral particles from an ore.

2. Related Art

As is well known by those skilled in the art, column flotation technology is a relatively recent innovation in mineral ore processing which has continually gained acceptance since Boutin and Tremblay patented the basic technology in Canadian Patent Nos. 694,547 and 680,576. On or about this point in time, Hollingsworth developed and ultimately patented the process disclosed in U.S. Pat. No. 3,298,519 for a counter-current flotation column. Although the primary purpose of the Hollingsworth counter-current flotation column and its successors was to float coarse (for example, greater than 48 mesh size) phosphate particles, flotation column development since that time has overwhelmingly addressed fine particle applications. The feeds for these fine particle applications (e.g., ultra-fine coal or metal-bearing sulfide ores) are typically such that 80% will pass a 74 micron screen, and many feeds are even much finer than this.

Much of the fine particle research in the flotation column art (for example, "Microbubble Flotation of Fine Coal", Luttrell, G. H. et al., *Column Flotation* '88, Society of Mining Engineers, Inc., Littleton, Colo., pp. 205–212; "Column Flotation and Bubble Generation Studies at the Bureau of Mines", McKay, J. D. et al., *Column Flotation* '88, Society of Mining Engineers, Inc., Littleton, Colo., pp. 173–186; "Recovery of Fine Coal from Preparation Plant Refuse Using Column Flotation", Parekh, B. K. et al., *Column Flotation* '88, Society of Mining Engineers, Inc., Littleton, Colo., pp. 227–234; "Column Flotation Parameters—Their Effects", Ynchausti, R. A. et al., *Column Flotation* '88, Society of Mining Engineers, Inc., Littleton, Colo., pp. 157–172) has emphasized sparging systems and the importance of using a proper combination of operating variables, particularly a net downflow of water which is characterized as a "positive bias" by those skilled in the art.

In the publication *Column Flotation* (Finch, J. A. and Dobby, G. S., Pergamon Press, Oxford, England, 1990; pp. 95 & 161) regarding the Canadian flotation column technology, the authors reviewed the column operating variables which have been developed and adopted for use in processing a variety of fine sulfide mineral applications. Of particular note, the following variable ranges were disclosed:

1. Bias rate of 0.0 to +0.4 centimeters/second;
2. Washwater rate of 0.2 to 0.5 centimeters/ second;
3. Froth depth of 0.6 to 1.5 meters;
4. Superficial air velocity of 0.8 to 3.0 centimeters/-second;
5. Carrying capacity of 1.4 to 16.1 grams/minutes/ square centimeter; and
6. Column throughput of 0.84 to 9.66 tons/hour/ square meter.

However, as noted hereinbefore, the above data relates to fine particle processing, and it has only been in the last two years that results have been reported of comprehensive analysis of column flotation of coarse particles (see "Flotation of Coarse Particles in a Counter-Current Column Cell", Soto, H. and Barbery. G., *Minerals & Metallurgical Processing*, Vol. 8, No. 1., pp. 16–21, 1991).

The authors of this publication focused their laboratory and pilot-scale sidestream test studies on coarse (14×48 mesh) phosphate ore. Thus, instead of using a deep froth with washwater, they injected elutriation water at the bottom of the flotation column cell to assist in levitating the fast-settling coarse particles. Detachment of bubbles from the coarse mineral particles which occurs due to turbulence in conventional mechanical-type cells (which have traditionally been used for coarse particle processing) was further prevented by reducing the superficial air velocity of the system. Soto and Barbery obtained good coarse particle recovery utilizing the following processing variables:

1. Bias rate of −0.5 centimeters/second;
2. Superficial air velocity of 0.8 centimeters/ second;
3. Carrying capacity of 18.4 grams/minute/square centimeter; and
4. Column throughput of 11.0 tons/hour/square meter.

Obviously, the washwater rate and froth depth variables are not relevant for the work conducted by Soto and Barbery.

Summarily, flotation columns are conventionally used in mineral flotation applications where the feed to the flotation column is ground at least 80% finer than 200 mesh (for example, about 74 microns). By contrast, flotation separations for coarse particles of about 20 mesh (840 microns) by 325 mesh (44 microns) feed stock are presently carried out in mechanical flotation cells which typically consist of either a rougher, a rougher-cleaner or a rougher-scavenger configuration.

In view of the long-felt-need for a viable process for flotation column processing of coarse minerals, applicant has now developed such a flotation column process which utilizes unexpected and surprisingly high solids loading to achieve an unexpected and surprisingly high throughput. The result of the novel process has significantly reduced capital costs due to reduced equipment size and floor space requirements as well as attendant reduced water consumption and lower energy and maintenance costs.

Disclosure of the Invention

In accordance with the present invention, applicant provides a high efficiency flotation column process for the recovery of selected relatively coarse mineral products from an ore which may be either metallic or non-metallic. The process includes establishing and maintaining a net upward flow of water (negative bias) through an upper portion of said flotation column, said net upward flow being maintained below a predetermined critical limit by introducing a selected flow of water at the top of said column and withdrawing a selected flow of pulp at the bottom of said column. Next, the process contemplates establishing and maintaining an upwardly moving stream of diffuse air which originates at the lower portion of the flotation column and has a superficial air velocity of between 0.5 and 2.0 centimeters/second. A feed stream comprising a slurry of the ore is then introduced into the upper portion of the flotation column wherein the mineral particles within the feed stream substantially range between about 20 mesh (840 microns) and about 325 mesh (44 microns) in size. The percent solids in the flotation columns is established and maintained at between about 35 to 50% and column throughput of the slurry is established and maintained at between about 1.8 to 4.0 tons/hour/square foot. Finally, the selected mineral particles are recovered from the upper portion of the flotation column.

It is therefore an object of the present invention to provide a high efficiency flotation column process for the recovery of selected mineral particles from an ore.

It is another object of the present invention to provide a high throughput and high solids flotation column process for the recovery of selected relatively coarse mineral particles from an ore.

It is still another object of the present invention to provide a high throughput and high solids content flotation process for the recovery of selected relatively coarse mineral particles from an ore which provides for improved recovery of the coarse particles from the feed stock, reduced size requirements of the flotation column, and reduction in water consumption of the floatation column.

Some of the objects of the invention having been stated, other objects will become evident as the description proceeds, when taken in connection with the accompanying drawings as best described hereinbelow.

DETAILED DESCRIPTION OF THE INVENTION

A DEISTER pilot-scale (6" dia.×13' high) column flotation cell was utilized to test applicant's novel process described herein on feldspar ore. The column was fitted with DEISTER's patented venturi-type bubble generation system, which required extremely large quantities of fresh water and frother to generate fine bubbles. The DEISTER column flotation cell had no reasonable method for tailings withdrawal or level/density control. Moreover, no instrumentation was provided to maintain consistent air and water flow rates to the sparger and the remainder of the column.

Figure 1:
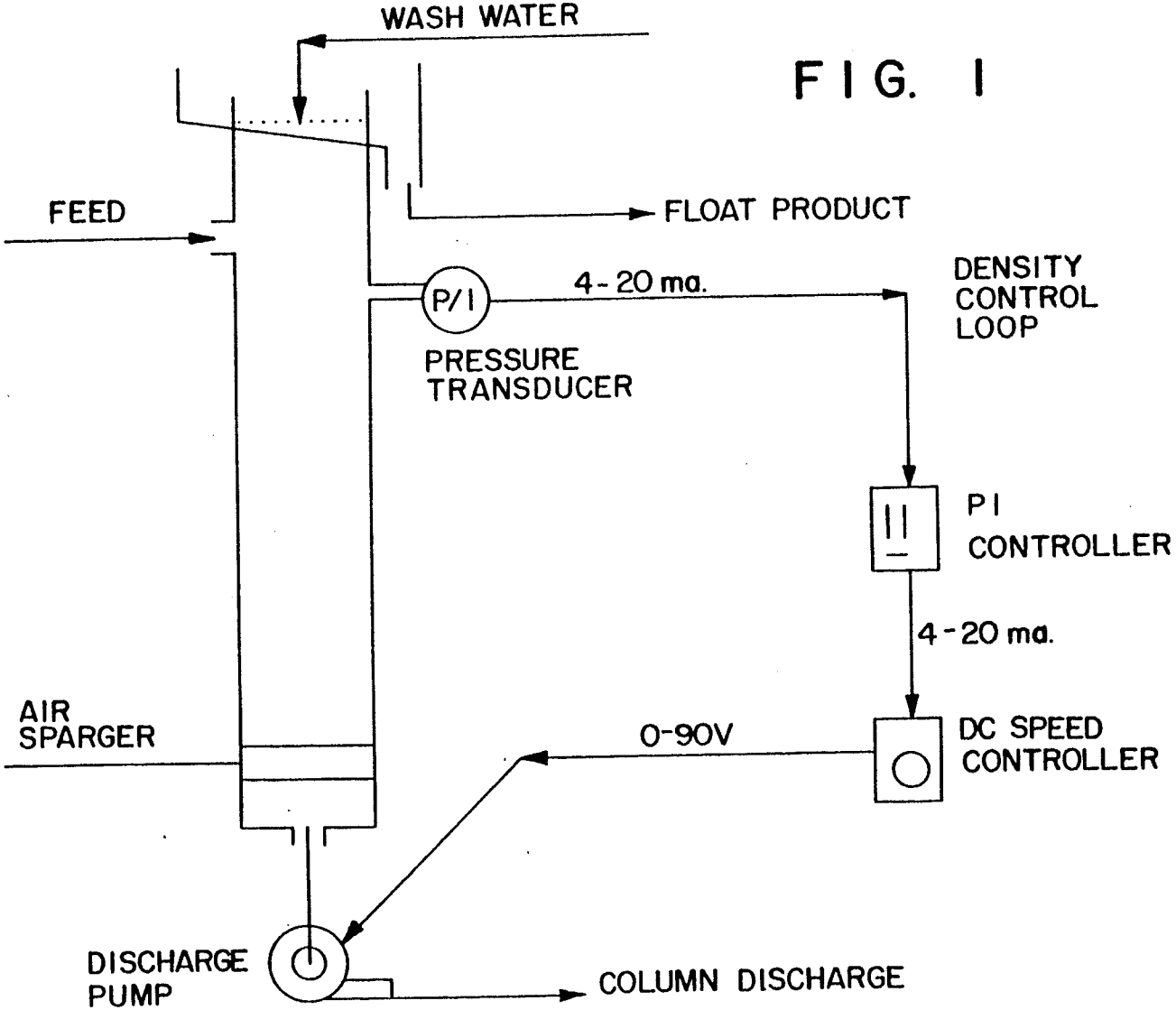
FIG. 1 is a schematic view of a representative flotation cell used in the practice of the novel process of the invention.

Thus, the DIESTER column flotation cell was modified as necessary. A schematic diagram of the modified flotation column cell is shown in FIG. 1. The flotation column was retrofitted to accommodate bubble generators which require minimal amounts of frother and water to operative effectively. The bubble generation systems acquired for the modified flotation column cell included:

1. A porous media sparger provided by the Deister Concentrator Company; and
2. A "Turbo-Air" sparging system.

Applicant designed a fully electronic level/density control loop, and a method was designed for positive withdrawal of column feed slurry from plant conditioners. The column was fitted with an adjustable feed entry pipe to allow the feed location to be varied. Applicant also designed and constructed a portable instrument panel to accurately meter air and water to the column. Chemical metering pumps were acquired to accurately meter and distribute both frother and collector to the column.

COLUMN FEED CHARACTERISTICS AND CONDITIONING

The feed to the column flotation cell was a mixture of feldspar minerals (plagioclase and microcline) and quartz. The concentration of these minerals and their corresponding chemical compositions are listed below:

| Mineralogical Composition | Chemical Composition | Wt. % in Column Feed |
|---|---|---|
| (Plagioclase) Feldspars (Microcline) | $Na_2O.Al_2O_3.6SiO_2$ $K_2O.Al_2O_3.6SiO_2$ | 65–70% |
| Quartz | $SiO_2$ | 30–35% |

Figure 2:
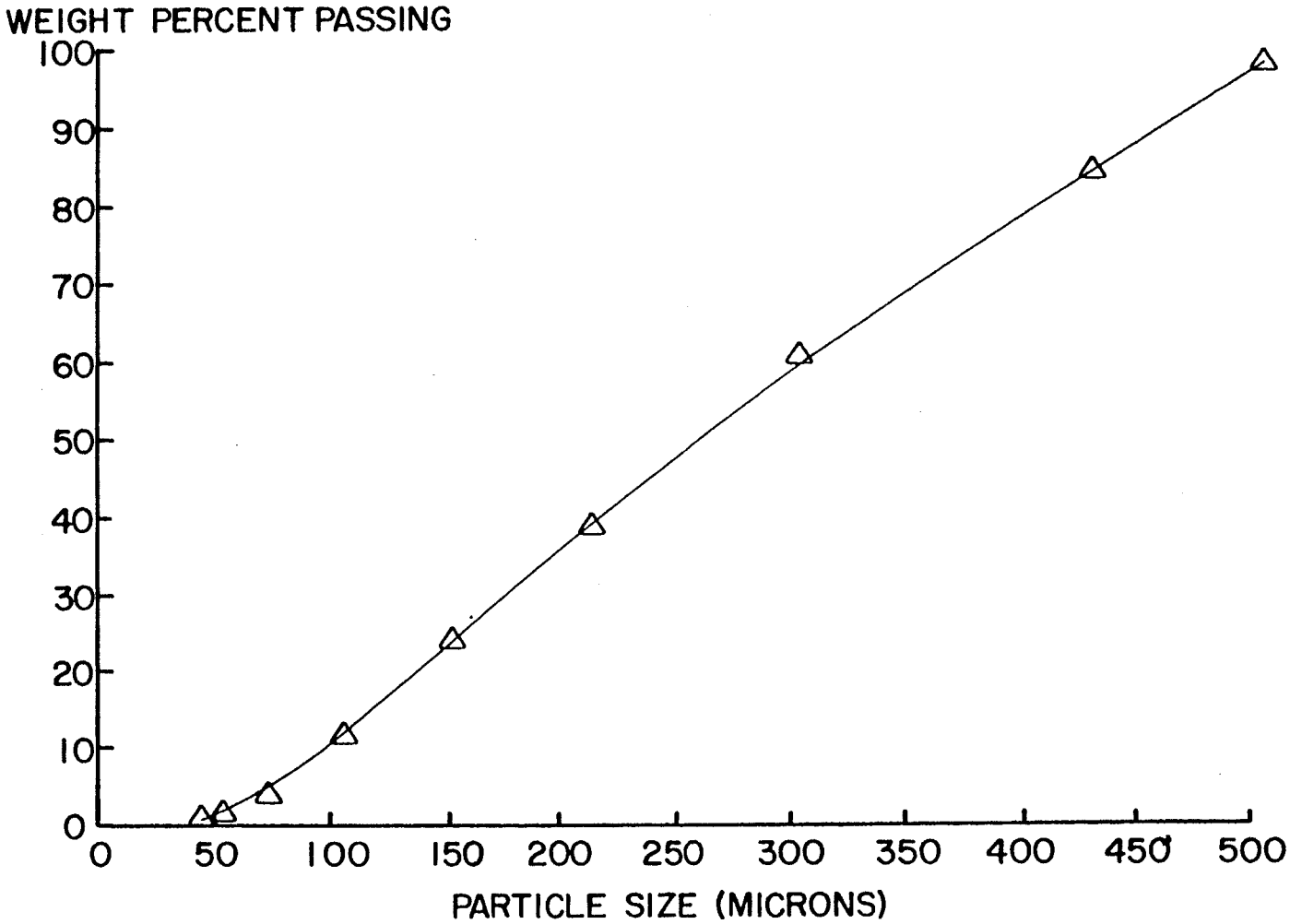
FIG. 2 is a graph of the particle size of the column feed (e.g., 50% of the feed passing 60 mesh (250 microns))

The particle size of the column feed (see FIG. 2) was 50% passing 60 mesh (250 microns). The solid specific gravity was approximately 2.6 grams/cm$^3$.

The feldspar and quartz mixture was diluted to approximately 58% solids and conditioned with hydrofluoric acid and a primary amine (tallow amine acetate). The conditioned pulp was either discharged into the mechanical flotation cells or was pumped into the column flotation cell for separation in accordance with the test equipment arrangement described below.

COLUMN SIDESTREAM TEST SET-UP AND PROCEDURES

Figure 3:
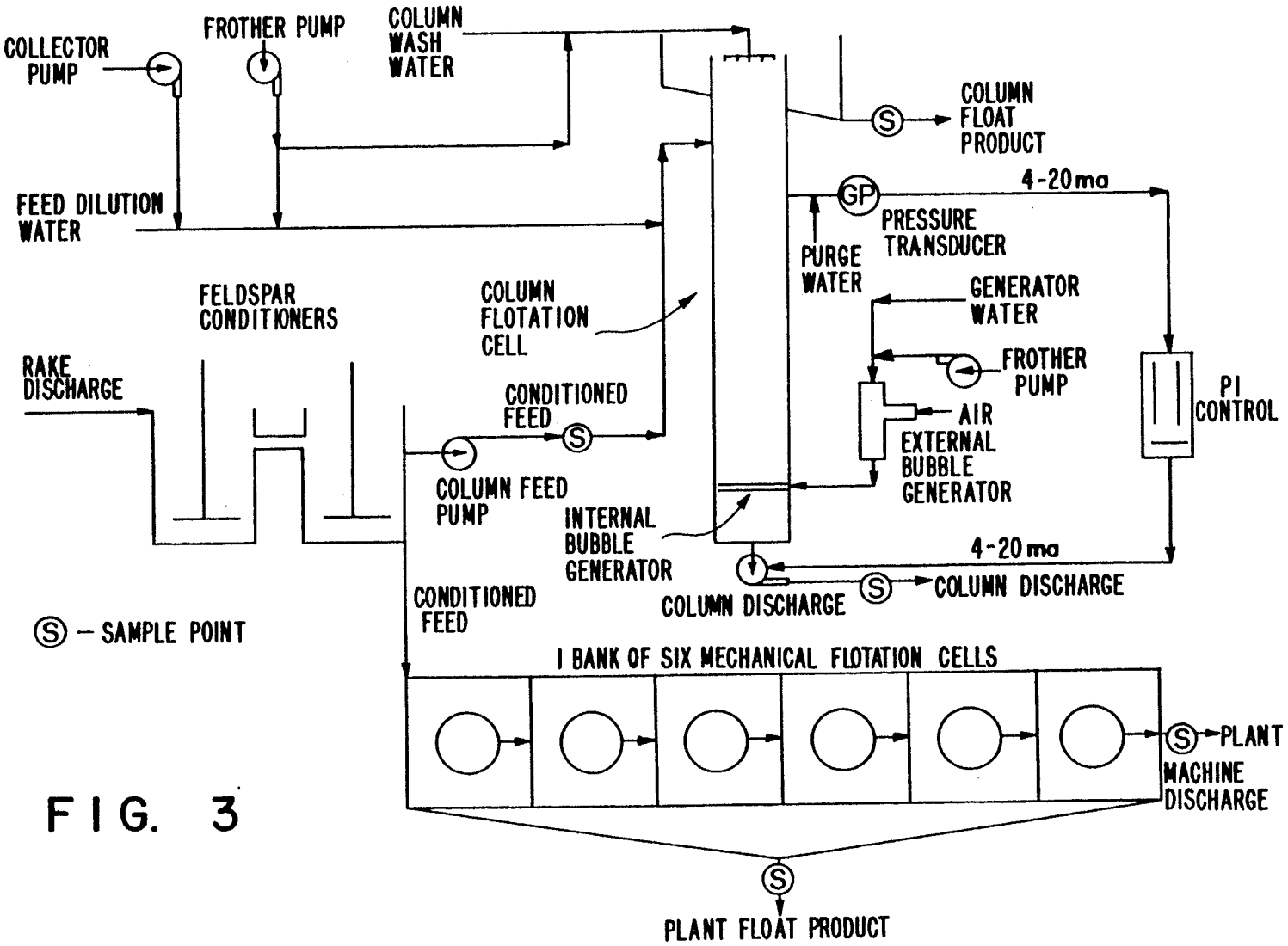
FIG. 3 is a schematic diagram of the flotation column and mechanical cell configuration used in the testing of the novel process of the invention.
Figure 4A:
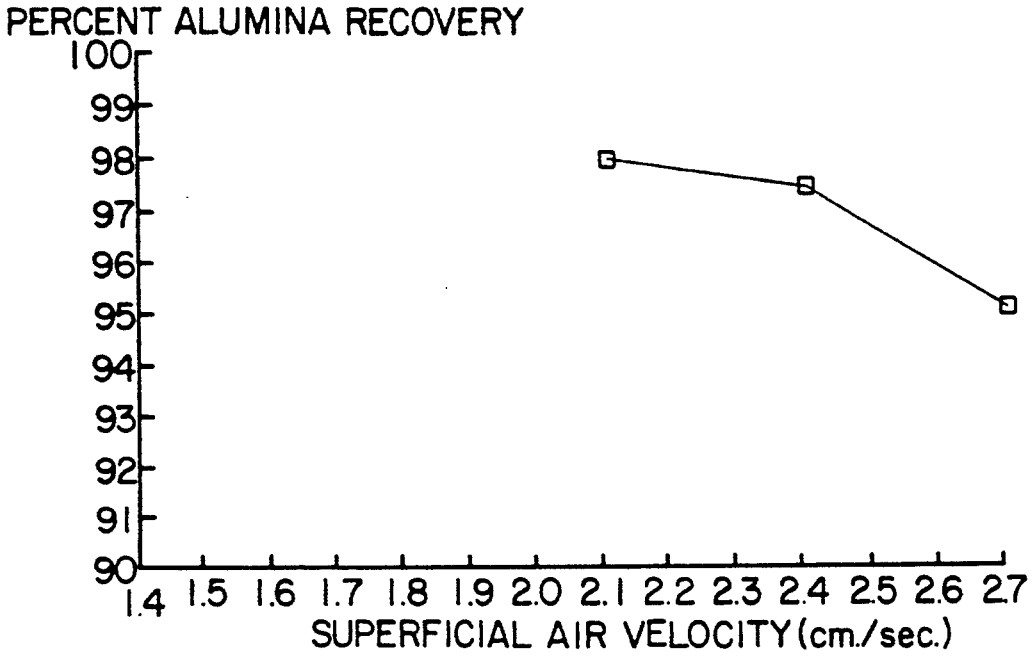
FIGS. 4A–4D are graphs of recovery versus superficial air velocity at increasing levels of percent solids.
Figure 4B:
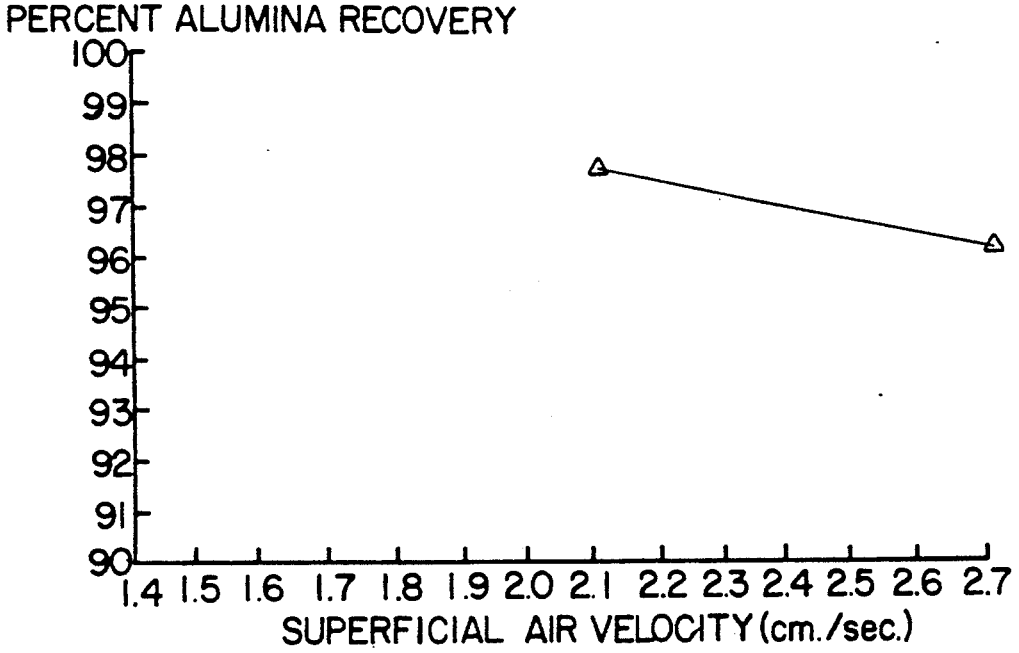
Figure 4C:
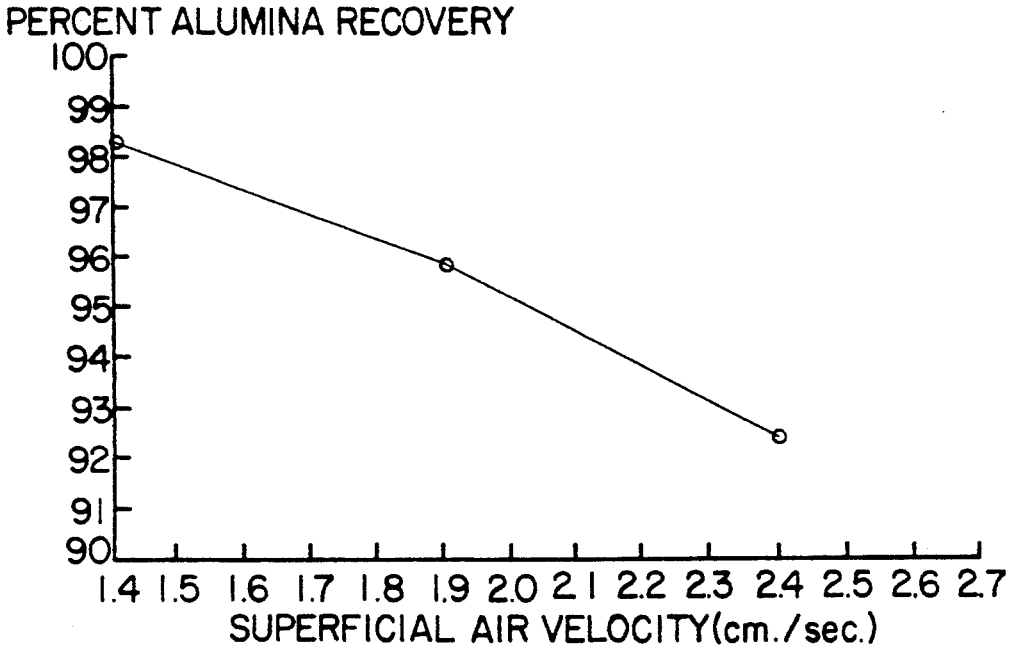
Figure 4D:
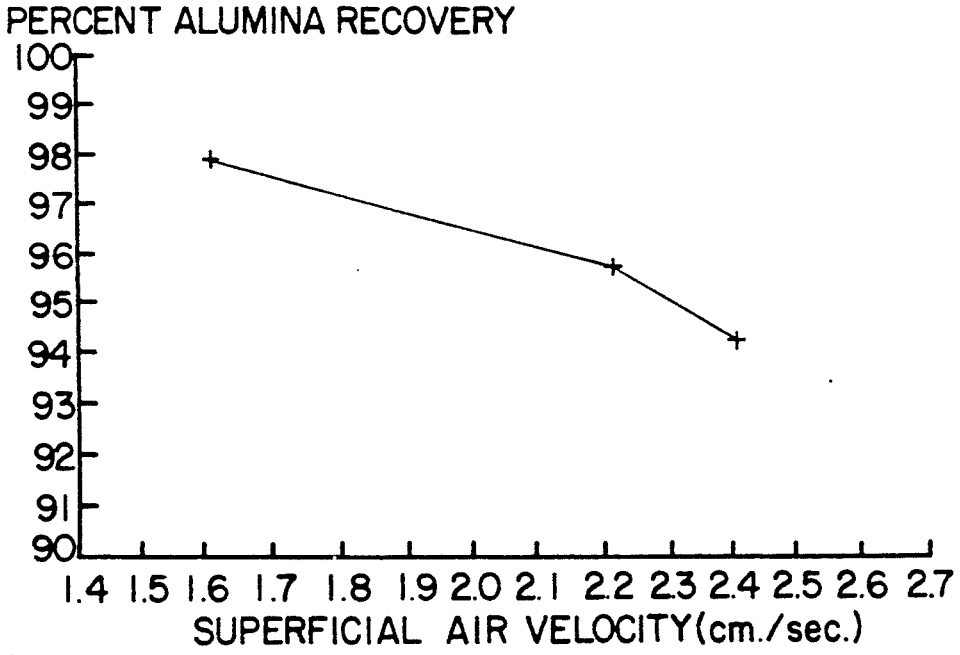

The column flotation cell was placed in parallel with mechanical flotation cells (see FIG. 3) to obtain comparative metallurgical data. A ¾-inch tygon tube, tapped into the second conditioning pot, provided the pulp sidestream to feed the flotation column cell. The pulp was pumped to the column using a positive displacement peristaltic pump. Water for the column cell was obtained from a water line located near the ore conditioner. The compressed air was provided by the instrument-air compressor, and two chemical metering pumps were installed to inject a polyglycol-ether frother (NOTTINGHAM ECONOFROTH 925) into the water entering the flotation column cell. A third metering pump was installed to add amine (NOTTINGHAM A-50) into the column feed pulp.

The sidestream test procedures were as follows:

1. Air, water, frother, and collector, and pulp flowrates were predetermined for each test with the aid of a spreadsheet developed on LOTUS-SYMPHONY software. The spreadsheet allowed applicant to determine the appropriate instrument settings for a given test.
2. Instrument settings and pulp feed rate were set at levels predetermined by the spreadsheet. Sufficient time was allowed to achieve steady-state in the column (approximately 15 to 30 minutes).
3. The column flotation product and column discharge were sampled simultaneously for 2 minutes. A 2-minute column feed sample (conditioner discharge) was collected after the flotation product and discharge samples were collected.
4. Flotation product and machine discharge streams of the mechanical cells were sampled at least once per test series.
5. All samples collected were weighed wet and dry. A sample was riffle-split from the dried material for chemical analysis.

CHEMICAL ANALYSIS AND CALCULATION OF BALANCES

All dried samples were analyzed for alumina ($Al_2O_3$) and iron as $Fe_2O_3$. Phase I samples were analyzed using atomic absorption. Phase II samples were analyzed by way of wavelength X-ray fluorescence. A complete mass and water balance around the flotation column cell was calculated using the wet and dry weights obtained from the 2-minute samples.

An alumina ($Al_2O_3$) balance was calculated for both the mechanical cells and the flotation column cell to track feldspar grade and recovery. The column metallurgical balance was calculated based on sample weights and assays. The mechanical cell balance was calculated solely based on assays of the feed and products using the following single product formula for assay-based recovery:

$$\text{Recovery} = \frac{c(f-t)}{f(c-t)} \times 100$$

c = percent $Al_2O_3$ in concentrate f = percent $Al_2O_3$ in the feed t = percent $Al_2O_3$ in the tails

RESULTS

The results of the experimental testing are summarized in Tables 1 and 2.

TABLE 1. PHASE 1 SERIES 1 AND 2

During the first phase of the project the flotation column cell was tested using novel column operating conditions developed for fine particle systems. The operating conditions tested in Phase I were:

1. High aeration rates (superficial air velocity) 3.0 cm/sec;
2. Low feed rates (throughput) 0.3 to 0.6 tph/ft$^2$;
3. The presence of a froth cleaning layer;
4. High frother dosage—0.1 to 0.3 lbs/ton;
5. Dilute flotation pulp (15–25% solids); and
6. Bias rate (negative) of about 0.1 centimeters/-second.

The results are presented in Table 1 and indicate that the flotation column outperformed the mechanical cells by producing a higher grade product and improved alumina recovery. The column required an additional 0.12 to 0.21 lbs/ton of a primary amine (NOTTINGHAM A-50) to maximize recovery, but the additional collector did not adversely affect product grade. The presence of a froth layer did not improve product grade and served only to reduce recovery of coarse feldspar. The coarse particle size and rapid flotation rate of the feldspar caused the froth layer to become unstable and collapse. The froth instability caused excessive turbulence at the top of the column resulting in bubble-particle detachment. Further modification of column variables was believed by applicant to be necessary to improve metallurgical performance and reduce operating and capital costs.

TABLE 1

| | | | | PHASE 1 TEST RESULTS | | | | | | |
|---|---|---|---|---|---|---|---|---|---|---|
| COLUMN TEST NO. OR PLANT | SAMPLE TIME | FEED RATE (TPH/SQ. FT.) | COLUMN PERCENT SOLIDS | SUPERFICIAL AIR VELOCITY (cm/sec.) | ADDITIONAL COLLECTOR ADDED (lbs./ton) | FROTHER DOSAGE (lbs./ton) | WT. % $AL_2O_3$ FLOAT PRODUCT | WT. % $AL_2O_3$ DISCHARGE | $AL_2O_3$ RECOVERY | WT. % YIELD |
| | | | | | SERIES 1 | | | | | |
| Column 35 | — | .30 | 21.5 | 3.2 | 0.0 | .24 | 19.1 | 2.44 | 93.6 | 65.2 |
| Column 36 | — | .34 | 22.1 | 3.1 | .19 | .24 | 18.7 | .70 | 98.4 | 70.1 |
| Column 36B | — | .31 | 20.8 | 3.1 | .21 | .25 | 18.5 | .80 | 98.1 | 68.9 |
| Column 37 | — | .43 | 25.1 | 3.1 | .15 | .19 | 18.8 | .99 | 97.8 | 70.0 |
| Plant | — | — | — | — | — | — | 18.1 | 1.55 | 95.5 | *64.4 |
| | | | | | SERIES 2 | | | | | |
| Column 38 | — | .44 | 25.0 | 3.0 | .12 | .14 | 19.8 | 1.63 | 96.0 | 66.5 |
| Column 39 | — | .48 | 26.2 | 3.0 | .18 | .13 | 19.8 | .93 | 98.0 | 69.4 |
| Column 40 | — | .60 | 27.9 | 3.0 | .14 | .10 | 19.2 | .86 | 98.0 | 68.7 |
| Column 41 | — | .57 | 26.6 | 3.0 | .12 | .11 | 19.1 | .88 | 97.9 | 68.2 |
| Plant | — | — | — | — | — | — | 18.8 | 1.13 | 97.1 | *66.6 |

*Calculated Yield

PHASE 2 SERIES 1 THROUGH 5

Figure 5:
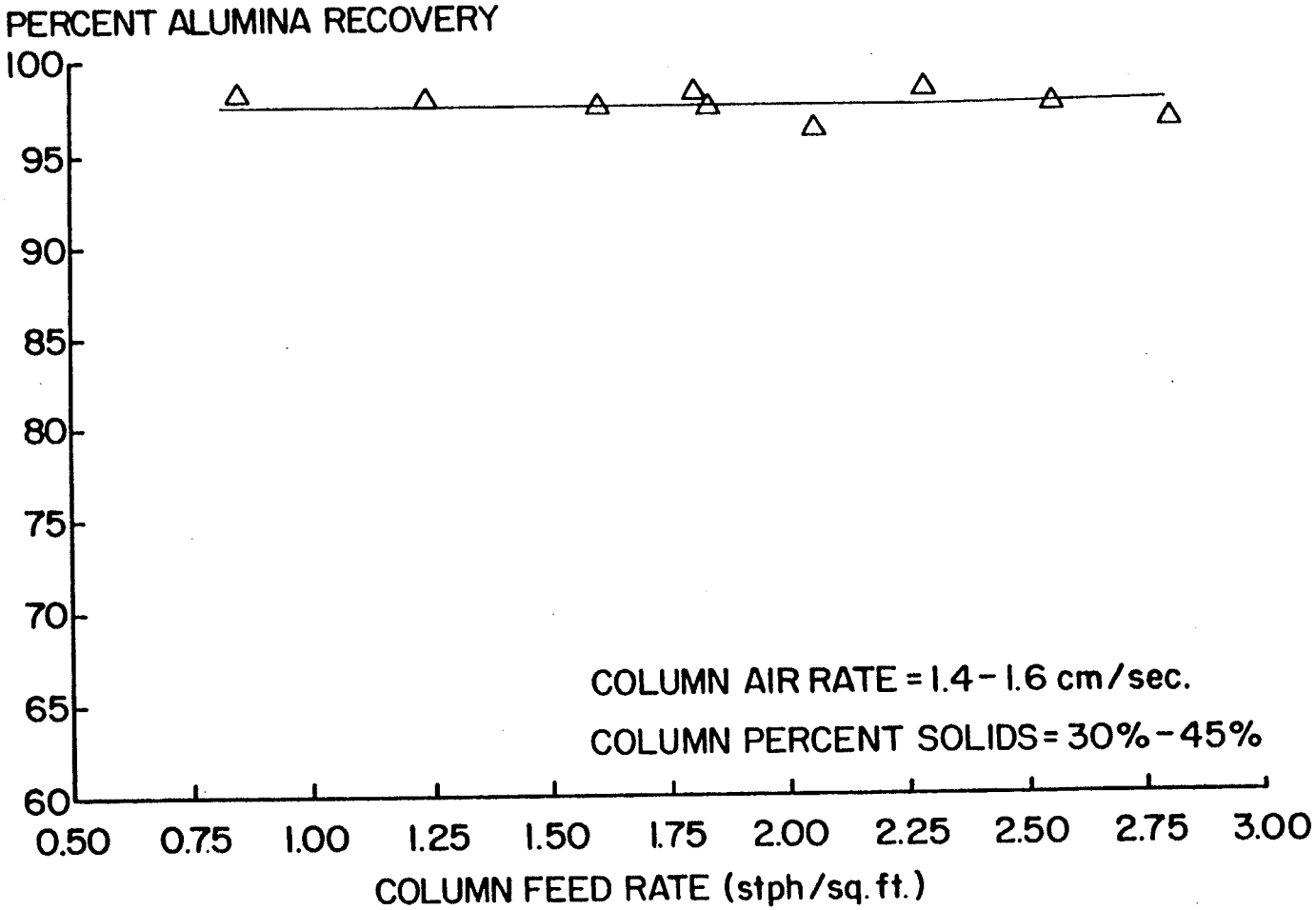
FIG. 5 is a graph of column feed rate versus percent alumina recovery.
Figure 6:
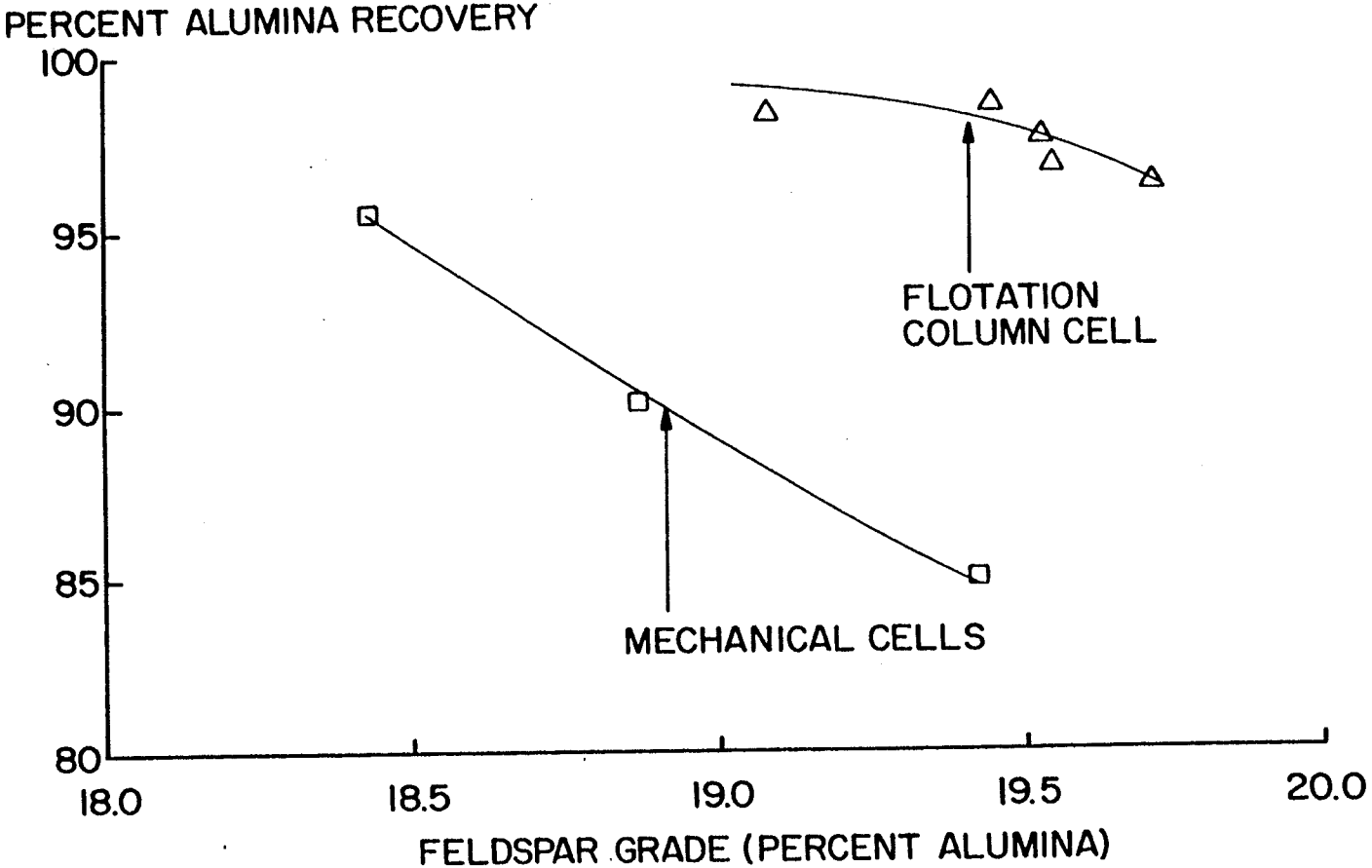
FIG. 6 is a graph illustrating feldspar grade versus percent recovery using the novel flotation column process of the invention versus conventional mechanical cells.

(Table 2, FIGS. 4 and 5)

The objective of Test Series 1 through 5 was to improve column metallurgical performance and decrease column operating costs by increasing throughput and reducing air and water consumption. Percent solids, aeration-rate (superficial air velocity) and feed rate were varied to determine the effect these variables had on column performance. The bias rate (negative) utilized was 0.2 to 0.4 centimeters/second. The results of these tests (see Table 2 and FIGS. 4A through 4D) indicate that column recovery reached a maximum at lower aeration rates (superficial air velocities), regardless of the feed rate and percent solids. Improved recovery at low aeration rates was attributed to reduced turbulence within the column. The less turbulent flow regime improved recovery of coarse particles by reducing bubble and particle detachment. Surprisingly, increasing column feed rate and percent solids did not result in a significant deterioration in product grade or recovery (see FIG. 5).

The results of Test Series 1 through 5 revealed that the flotation column was very efficient when operated at low aeration rates (superficial air velocities of 1.4 to 1.6 cm/sec), high feed rates (1.8 tph/sq. ft.) and high percent solids (35–40%). This unique set of operating conditions resulted in a reduction in column operating costs (air and water consumption) while maintaining high product quality and recovery.

mize column throughput The superficial air velocity (aeration rate) was maintained between 1.4 and 1.6 cm/sec and the additional amine (NOTTINGHAM A-50) added to the column feed was less than 0.1 lbs/ton. Column percent solids were maintained near 45 percent and throughput was varied from 1.78 to 2.78 tph/sq. ft. Testing beyond 2.78 tph/sq. ft. was not performed due to the limited capacity of the column feed pump. The bias rate (negative) utilized was 0.2 to 0.4 centimeters/ second. The results of these tests (see Table 2) indicate that column metallurgical performance did not deteriorate at the high feed rates. These exceptionally and surprisingly high column throughputs resulted in a drastic reduction in the air, water, frother and column area requirements per ton of processed ore.

Applicant developed performance curves (see FIG. 5) based on metallurgical balances (see Table 3) calculated for both the mechanical cells and the flotation column. Analysis of these curves indicates that for a target feldspar grade of 19.0% alumina, the column

TABLE 2

PHASE 2 TEST RESULTS

| COLUMN TEST NO. OR PLANT | SAMPLE TIME | FEED RATE (TPH/ SQ. FT.) | COLUMN PERCENT SOLIDS | SUPER-FICIAL AIR VELOC-ITY (cm/sec.) | ADDI-TIONAL COLLECTOR ADDED (lbs./ton) | FROTH-ER DOS-AGE (lbs./ton) | WT. % $AL_2O_3$ FLOAT PRO-DUCT | WT. % $AL_2O_3$ DIS-CHARGE | $AL_2O_3$ RECOV-ERY | WT. % YIELD |
|---|---|---|---|---|---|---|---|---|---|---|
| | | | | | SERIES 1 | | | | | |
| Column 1 | 1:45 PM | .51 | 26.3 | 2.7 | .17 | .08 | 19.23 | 2.09 | 95.0 | 67.8 |
| Column 2 | 2:00 PM | .51 | 25.0 | 2.4 | .18 | .08 | 18.88 | 1.2 | 97.4 | 70.1 |
| Column 3 | 2:10 PM | .51 | 25.5 | 2.1 | .17 | .08 | 18.76 | .98 | 97.9 | 70.7 |
| Plant | 1:45 PM | — | — | — | — | — | 18.74 | 4.99 | 86.5 | *63.1 |
| | | | | | SERIES 2 | | | | | |
| Column 4 | 2:45 PM | .72 | 28.9 | 2.7 | .16 | .11 | 19.31 | 1.63 | 96.3 | 68.6 |
| Column 5 | 3:00 PM | .72 | 26.8 | 2.1 | .18 | .12 | 18.66 | 1.07 | 97.8 | 71.8 |
| Plant | 2:45 PM | — | — | — | — | — | 18.18 | 4.32 | 89.7 | *67.4 |
| | | | | | SERIES 3 | | | | | |
| Column 6 | 11:40 AM | .92 | 35.0 | 2.4 | .13 | .08 | 19.39 | 2.77 | 92.9 | 65.2 |
| Column 7 | 12:25 PM | .92 | 34.4 | 1.9 | .13 | .09 | 18.91 | 1.79 | 95.8 | 68.3 |
| Column 8 | 12:40 PM | .82 | 32.5 | 1.4 | .14 | .09 | 18.28 | .82 | 98.3 | 72.2 |
| Plant | 11:40 AM | — | — | — | — | — | 18.56 | 2.01 | 95.6 | *70.0 |
| | | | | | SERIES 4 | | | | | |
| Column 9 | 1:10 PM | 1.21 | 31.2 | 2.4 | .13 | .09 | 19.08 | 2.21 | 94.3 | 65.7 |
| Column 10 | 1:25 PM | 1:21 | 32.7 | 2.2 | .13 | .09 | 19.03 | 1.66 | 95.8 | 66.8 |
| Column 11 | 1:40 PM | 1.21 | 37.0 | 1.6 | .13 | .09 | 18.37 | .98 | 97.9 | 71.7 |
| Column 12 | 1:50 PM | 1.57 | 40.2 | 1.6 | .07 | .10 | 18.57 | 1.18 | 97.6 | 71.4 |
| Plant | 1:10 PM | — | — | — | — | — | 18.64 | 1.11 | 97.4 | *68.7 |
| | | | | | SERIES 5 | | | | | |
| Column 13 | 1:40 PM | 1.81 | 44.6 | 1.6 | .08 | .05 | 18.95 | 1.12 | 97.5 | 70.1 |
| Plant | 1:10 PM | — | — | — | — | — | 18.99 | 2.95 | 92.6 | *66.1 |
| | | | | | SERIES 6 | | | | | |
| Column 14 | 12:30 PM | 1.78 | 44.2 | 1.6 | .10 | .04 | 19.06 | .79 | 98.3 | 70.8 |
| Plant | 12:30 PM | — | — | — | — | — | 18.86 | 3.95 | 90.1 | 65.5 |
| Column 15 | 1:10 PM | 2.03 | 44.6 | 1.6 | .10 | .04 | 19.7 | 1.53 | 96.3 | 66.9 |
| Plant | 1:10 PM | — | — | — | — | — | 19.42 | 5.07 | 84.9 | *59.5 |
| Column 16 | 1:55 PM | 2.26 | 42.8 | 1.4 | .10 | .04 | 19.43 | .59 | 98.5 | 67.1 |
| Plant | 1:55 PM | — | — | — | — | — | 18.41 | 2.02 | 95.5 | *69.9 |
| Column 17 | 2:30 PM | 2.53 | 43.0 | 1.4 | .09 | .03 | 19.51 | 1.03 | 97.6 | 68.5 |
| Column 18 | 3:00 PM | 2.78 | 45.1 | 1.4 | .08 | .03 | 19.33 | 1.33 | 96.8 | 67.5 |
| Plant | 2:30 PM | — | — | — | — | — | 18.41 | 2.02 | 95.5 | *69.9 |

*Calculated Yield

Phase 2 Series 6

The objective of Test Series 6 was to further increase percent solids and solid feed rate in an effort to maxialumina recovery was near 98% while the mechanical cells (plant) recovered only 87% of the available alumina.

TABLE 3

| Metallurgical Balances: Flotation Column and Plant, Series 6 | WT % | WT. % ALUMINA | ALUMINA DIST. (ASSAYS) | ALUMINA DIST. (WEIGHTS) | WT % IRON |
|---|---|---|---|---|---|
| TEST 14 MASS AND METALLURGICAL BALANCE FOR FLOTATION COLUMN AND PLANT | | | | | |
| (Column Sample 12:30 PM) | | | | | |
| FLOTATION PRODUCT | 70.8 | 19.06 | 98.3 | 98.3 | 0.044 |
| COLUMN DISCHARGE | 29.2 | 0.79 | 1.7 | 1.7 | 0.011 |
| FEED (CALC.) | 100.0 | 13.72 | 100.0 | 100.0 | |
| CONDITIONER DIS. | 100.0 | 13.73 | | | 0.038 |
| (PLANT SAMPLE 12:30 PM) | | | | | |
| FLOAT PRODUCT | 65.6 | 18.86 | 90.1 | | 0.055 |
| MACHINE DISCHARGE | 34.4 | 3.95 | 9.9 | | 0.021 |
| CONDITIONAL DIS. | 100.0 | 13.73 | 100.0 | | 0.038 |
| TEST 15 MASS AND METALLURGICAL BALANCE FOR FLOTATION COLUMN AND PLANT | | | | | |
| (Column Sample 1:10 PM) | | | | | |
| FLOTATION PRODUCT | 66.9 | 19.7 | 96.2 | 96.3 | 0.05 |
| COLUMN DISCHARGE | 33.1 | 1.53 | 3.8 | 3.7 | 0.017 |
| FEED (CALC.) | 100.0 | 13.69 | 100.0 | 100.0 | |
| CONDITIONER DIS. | 100.0 | 13.61 | | | 0.03 |
| (PLANT SAMPLE 1:10 PM) | | | | | |
| FLOAT PRODUCT | 59.5 | 19.42 | 84.9 | | 0.036 |
| MACHINE DISCHARGE | 40.5 | 5.07 | 15.1 | | 0.016 |
| CONDITIONAL DIS. | 100.0 | 13.61 | 100.0 | | 0.03 |
| TEST 16 MASS AND METALLURGICAL BALANCE FOR FLOTATION COLUMN AND PLANT | | | | | |
| (Column Sample 1:55 PM) | | | | | |
| FLOTATION PRODUCT | 67.1 | 19.43 | 98.6 | 98.5 | 0.039 |
| COLUMN DISCHARGE | 32.9 | 0.59 | 1.4 | 1.5 | 0.011 |
| FEED (CALC.) | 100.0 | 13.23 | 100.0 | 100.0 | |
| CONDITIONER DIS. | 100.0 | 13.48 | | | 0.03 |
| (PLANT SAMPLE 1:55 PM) | | | | | |
| FLOAT PRODUCT | 69.9 | 18.41 | 95.5 | | 0.036 |
| MACHINE DISCHARGE | 30.1 | 2.02 | 4.5 | | 0.016 |
| CONDITIONAL DIS. | 100.0 | 13.48 | 100.0 | | 0.03 |
| TEST 17 MASS AND METALLURGICAL BALANCE FOR FLOTATION COLUMN AND PLANT | | | | | |
| (Column Sample 2:30 PM) | | | | | |
| FLOTATION PRODUCT | 68.5 | 19.51 | 97.5 | 97.6 | 0.04 |
| COLUMN DISCHARGE | 31.5 | 1.03 | 2.5 | 2.4 | 0.013 |
| FEED (CALC.) | 100.0 | 13.69 | 100.0 | 100.0 | |
| CONDITIONER DIS. | 100.0 | 13.48 | | | 0.034 |
| (PLANT SAMPLE 2:30 PM) | | | | | |
| FLOAT PRODUCT | 69.9 | 18.41 | 95.5 | | 0.036 |
| MACHINE DISCHARGE | 30.1 | 2.02 | 4.5 | | 0.016 |
| CONDITIONAL DIS. | 100.0 | 13.48 | 100.0 | | 0.03 |
| TEST 18 MASS AND METALLURGICAL BALANCE FOR FLOTATION COLUMN | | | | | |
| (Column Sample 2:55 PM) | | | | | |
| FLOTATION PRODUCT | 67.5 | 19.33 | 96.7 | 96.8 | 0.040 |
| COLUMN DISCHARGE | 32.5 | 1.33 | 3.3 | 3.2 | 0.045 |
| FEED (CALC.) | 100.0 | 13.47 | 100.0 | 100.0 | |
| CONDITIONER DIS. | 100.0 | 13.42 | | | 0.046 |

Summarily, the results of the sidestream tests indicate that the flotation column cell outperformed the mechanical flotation cells that are conventionally used to process coarse feldspar ore. A unique set of operating conditions was developed, resulting in extremely high throughputs (>2.5 tph/sq. ft.) while maintaining superior product grade and recovery. Low aeration rates (1.4–1.6 cm/sec) and high percent solids (45.0%) were key variables contributing to the high capacity and efficiency. Column alumina recoveries ranged from 96.2% to 98.6%, with product grades ranging from 19.06% to 19.70% alumina. The corresponding mechanical cell alumina recoveries ranged from 84.9% to 95.5%, with product grades ranging from 18.41% to 19.42% alumina.

Also, with respect to bias rates utilized by the process of the invention, it will be appreciated by those skilled in the art that negative bias is a net upward flow of water through the upper portion of the flotation column (approximately the portion above the entry point of the feed stream and the top of the column). Applicant further discovered that the net upward flow (negative bias) of water through the upper portion of the column should not exceed the terminal settling velocity of the finest hydrophilic particles. In the event that the net upward flow should exceed this critical limit, the concentrate would become contaminated with fine hydrophilic particles recovered as a result of elutriation rather than flotation. Applicant discovered that the (negative) bias critical limit is about 0.7 centimeters/second, and that this critical limit could be maintained by introducing a selected flow of water at the top of the flotation column and withdrawing a selected flow of pulp at the bottom of the column so as not to exceed the critical limit.

TEST RESULTS ADDING AMINE TO FEED STREAM

The experimental procedures and data analysis for this four-hour test were carried out under conditions identical to those set forth above in the previous experimental test. Column feed rate, percent solids and air rate were fixed for the entire four-hour test. The amount of amine (NOTTINGHAM A-50) added to the column was set at 0.09 lbs/ton for the first three hours and was shut off for the final hour. The flotation column cell and the mechanical cells (plant) were sampled at 20 to 30 minute intervals over the four-hour period. Each set of samples was analyzed and a complete mass, metallurgical and water balance was developed.

Column operating conditions for the four hour plant sidestream test are presented in Table 4. The column feed rate was fixed at 2.55 tph/sq. ft. percent solids were maintained near 45 percent and the column superficial air velocity was 1.4 cm/sec. Approximately 0.09 lbs/ton of an amine (NOTTINGHAM A-50) was added to the column feed stream for the first 3 hours of the test (Tests 19-A through 19-H). The amine was shut-off for the final hour of the four-hour test (Tests 19-I through 19-K).

Tests 19-A Through 19-H (Amine Added to the Column Feed)

Figure 7:
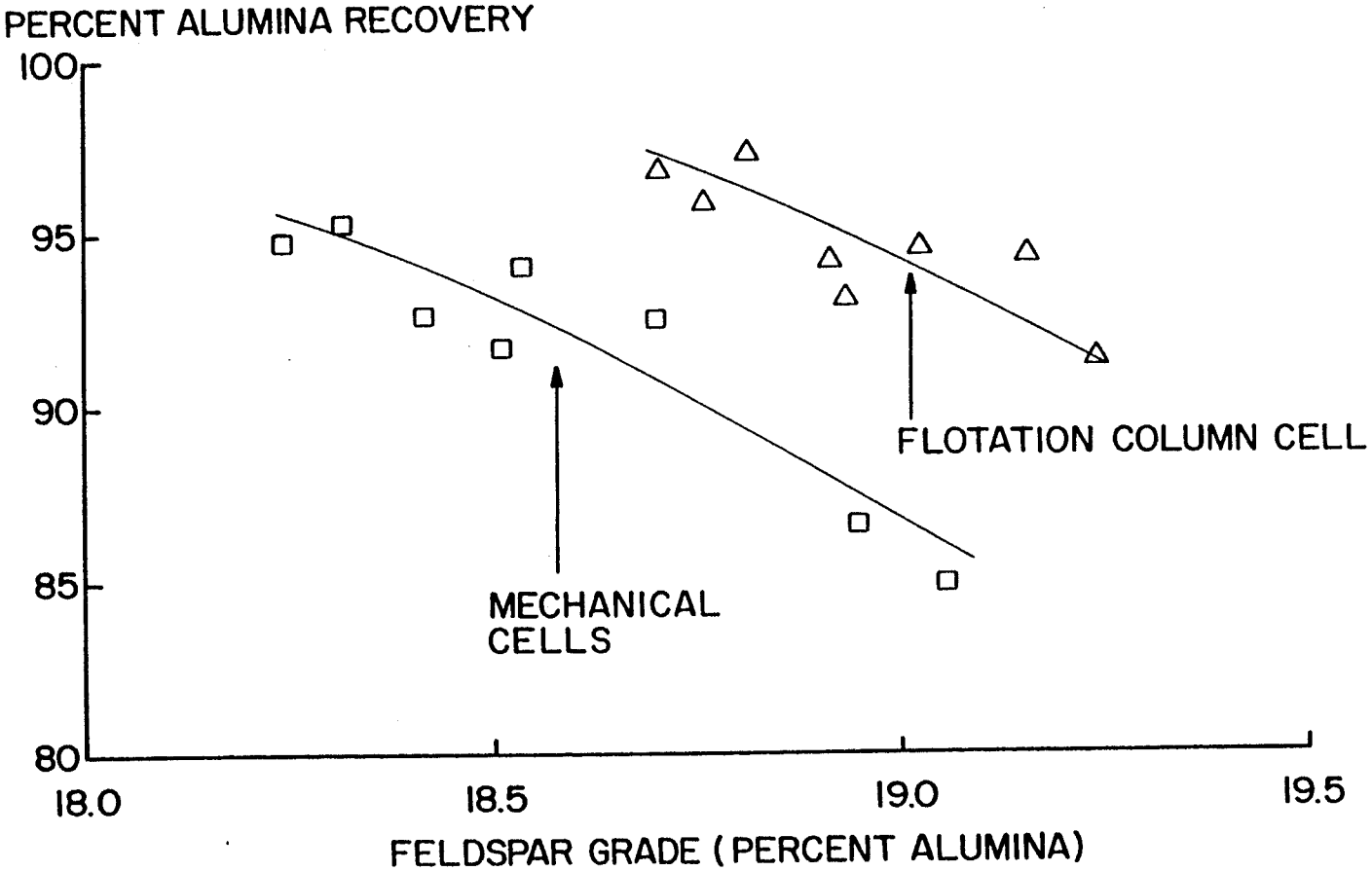
FIG. 7 is a graph illustrating feldspar grade versus percent recovery utilizing the novel flotation column flotation process of the invention as contrasted to conventional mechanical cells when a selected amount of amine is added to the feed stock.

Approximately 0.09 lbs/ton amine was added to the column feed for the first three hours of the test (Tests 19-A through 19-H). The results of the first three hours of the testing (see Table 5) indicate that the flotation column consistently outperformed the mechanical cells. Column alumina recoveries ranged from 91.3% to 97.3% with product grades ranging from 18.75% to 19.14% alumina. The corresponding mechanical cell alumina recoveries ranged from 84.9% to 94.8% with produce grades ranging from 18.23 to 19.05%. The additional amine in the column feed did not cause a deterioration in product grade. Efficiency curves developed for both the column cell and the mechanical cells are presented in FIG. 7.

TABLE 4

| | Column Operating Conditions For the 4-Hour Sidestream Test | | | | |
|---|---|---|---|---|---|
| Test No. | Column Throughput (tph/sq. ft.) | Column Percent Solids | Amine Added to lbs/ton | Frother Added to Column | Superficial Air Velocity (cm/sec) |
| 19-A through 19-H | 2.55 | 45 | 0.09 | 0.03 | 1.4 |
| 19-I through 19-K | 2.55 | 45 | 0.00 | 0.03 | 1.4 |

TABLE 5

| | | 4-Hour Sidestream Test Results | | | |
|---|---|---|---|---|---|
| | | Plant | | Column | |
| Test No. | Time | Grade Wt. % $Al_2O_3$ | Prod. Dist. $Al_2O_3$ Recovery | Grade Wt. % $Al_2O_3$ | Prod. Dist. $Al_2O_3$ Recovery |
| 19-A | 11:15 A.M. | 18.30 | 95.2 | 18.80 | 97.3 |
| 19-B | 11.35 A.M. | 18.23 | 94.8 | 18.69 | 96.9 |
| 19-C | 12:00 Noon | 18.52 | 94.0 | 18.75 | 5.9 |
| 19-D | 12:20 P.M. | 18.69 | 92.5 | 18.92 | 93.1 |

TABLE 5-continued

| | | 4-Hour Sidestream Test Results | | | |
|---|---|---|---|---|---|
| | | Plant | | Column | |
| Test No. | Time | Grade Wt. % $Al_2O_3$ | Prod. Dist. $Al_2O_3$ Recovery | Grade Wt. % $Al_2O_3$ | Prod. Dist. $Al_2O_3$ Recovery |
| 19-E | 12:40 P.M. | 18.50 | 91.7 | 19.01 | 94.5 |
| 19-F | 1:00 P.M. | 18.40 | 92.6 | 18.90 | 94.3 |
| 19-G | 1:20 P.M. | 18.94 | 86.6 | 19.23 | 91.3 |
| 19-H | 1:50 P.M. | 19.05 | 84.9 | 19.14 | 94.3 |
| 19-I* | 2:20 P.M. | 18.73 | 92.7 | 18.76 | 95.2 |
| 19-J* | 2:50 P.M. | 18.61 | 93.2 | 18.82 | 94.4 |
| 19-K* | 3:20 P.M. | 18.73 | 90.6 | 18.77 | 93.2 |

*No Additional Amine (A-50) Added

Tests 19-I Through 19-K (No Amine Added to Column Feed)

The object of Tests 19-I through 19-K was to eliminate additional amine from the column feed to determine its effect on column metallurgical performance. The additional amine was shut-off for the final hour of the four-hour test. The results indicate that the column metallurgical performance suffered in the absence of the amine, but the column continued to yield higher alumina recoveries than the mechanical cells. Column alumina recoveries ranged from 93.2% to 95.2% with product grades ranging from 18.76% to 18.82%. The corresponding mechanical cell alumina recoveries ranged from 90.6% to 92.7% with product grades ranging from 18.61% to 18.72%.

Figure 8:
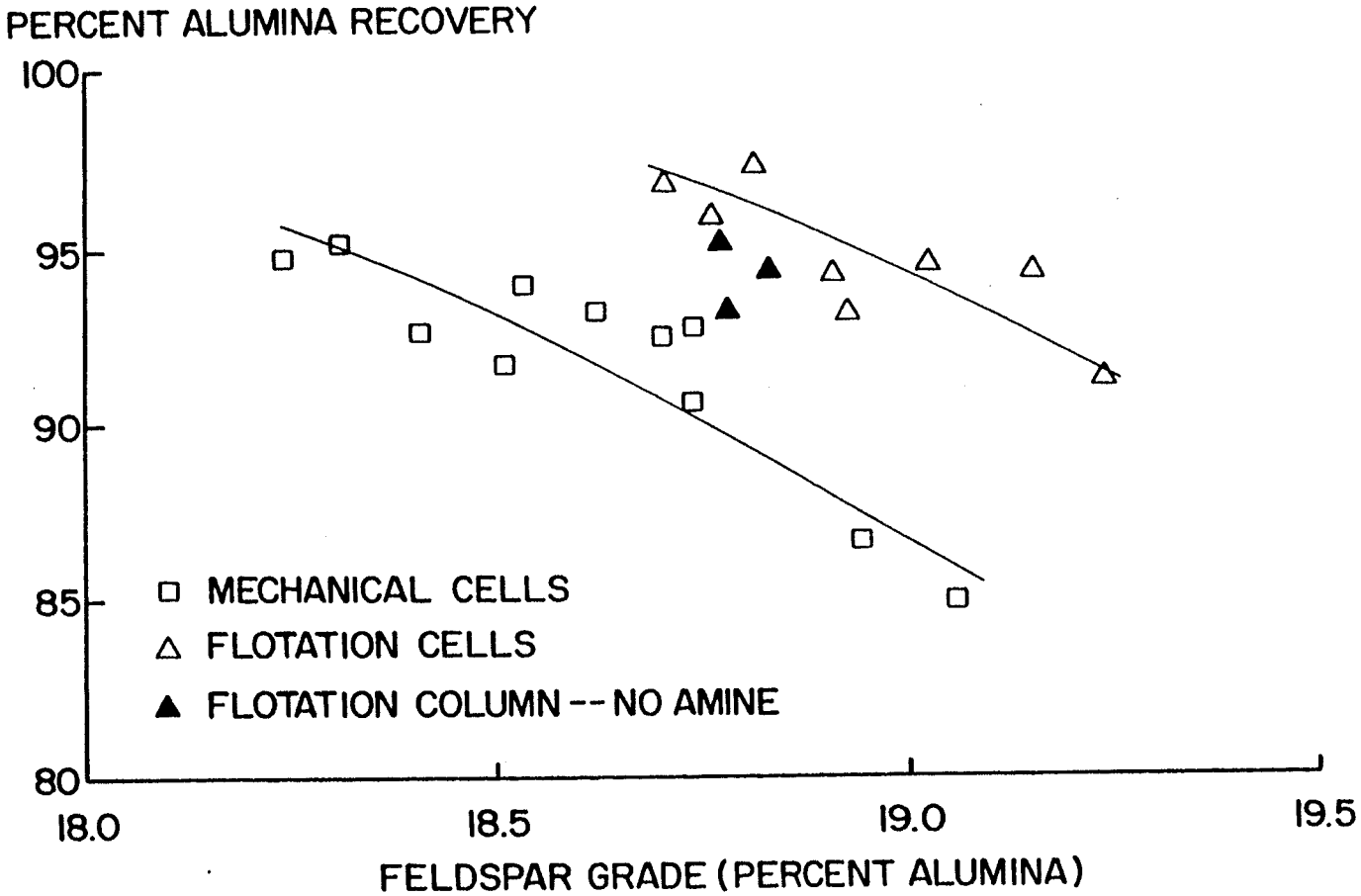
FIG. 8 is a graph illustrating feldspar grade versus percent recovery utilizing the novel flotation column process of the invention both with and without the addition of a selected amount of amine to the feed stock.

Comparison: Amine Added vs. No Amine Added (FIG. 8)

Performance data generated during the final hour (no amine added) of the test was superimposed onto the efficiency curves which represent the first three hours (amine added) of the four-hour test. The data indicates that the column performed more efficiently when a relatively low dosage (0.09 lbs/ton) of amine (NOTTINGHAM A-50) was added to the column feed stream. Testing performed with the additional amine in the feed produced superior grade and recovery.

Summarily, the results of the four-hour sidestream test indicate that the flotation pilot column consistently outperformed the mechanical cells that are currently used to process feldspar ore. Column alumina recoveries ranged from 91.3% to 97.3%, with product grades ranging from 18.69% to 19.23% alumina. The corresponding mechanical cell recoveries ranged from 84.9% to 95.2%, with product grades ranging from 18.23% to 19.05% alumina. The addition of 0.09 lbs/ton of amine (NOTTINGHAM A-50) into the column feed stream appeared to enhance column metallurgical performance.

Although the tests set forth above are directed to utilizing the novel process of the invention for processing non-metallic feldspar ores, applicant contemplates that many different types of both non-metallic and metallic ores can be processed including, but not limited to, ores such as phosphate, quartz, lithium, mica as well as base metal sulphides and coal. Thus, applicant does not contemplate limiting the scope of the instant novel process of the invention to merely processing relatively coarse feldspar ore, but quite to the contrary, contemplates that the novel process of the invention can be used to accomplish high throughputs, high solids operating conditions for the processing of many types of non-metallic as well as metallic ores, minerals or other materials. The extremely surprising and unexpected result of the novel process of the invention is the ability to process a relatively coarse ore, mineral or other material at a very high flotation column efficiency by utilizing very high throughput and very high solids operating conditions.

Furthermore, although specific operating parameters for processing relatively coarse ore, minerals or other materials have been set forth hereinabove in the two (2) detailed experimental tests, applicant contemplates that a broader range of process parameters can be utilized in the inventive flotation column process of the invention while maintaining the efficacy thereof. More specifically, applicant contemplates that a superficial air velocity between about 0.5 and 2.0 cm/sec. can be introduced in the lower portion of the flotation column; the percent solids which is established and maintained in the flotation column can range between about 35 and 50%; the column throughput Which is established and maintained in the flotation column can range between about 1.8 and 4.0 tons/hour/sq. ft.; the net upward flow of water (negative bias) through the upper portion of the flotation column should not exceed 0.7 cm/sec.; the primary amine (which optionally can be added to the feed stock of certain ores such as feldspar) can range between about 0.09 and 0.21 lbs/ton; the recovery rate for the novel flotation column will be between about 90.0 and 98.0%; and the mineral particles within the slurry of ore introduced into the feed stream can range between about 20 mesh (850 microns) and about 325 mesh (44 microns) in size.

For example, although the test results will not be reported in detail herein, applicant has also conducted experimental tests of the novel process of the invention on 20×200 mesh North Carolina phosphate ore using the high throughput, high solids operating parameters achieved in the instant invention. More specifically, column flotation was performed at 45% solids in a 9.5 centimeter (3.75 inches) diameter by 2.26 meter (7.4 feet) tall flotation column at throughputs of 19.1 tons/hour/sq. meter (2.0 tons/hour/sq. ft.) and 31.7 tons/hour/sq. meter (3.3 tons/hour/sq. ft.). A negative bias of 0.2 to 0.4 centimeters/second net upward flow of water through the upper portion of the flotation column was utilized. The results of the testing were recoveries in excess of 98% of the phosphate value at the lower of the two aforementioned throughputs while obtaining concentrate grades containing over 28% $P_2O_5$ in that recovery. Recoveries of approximately 95% of the phosphate value were obtained at the higher of the two aforementioned throughputs while making concentrate averaging 27.6% $P_2O_5$.

It will be understood that various details of the invention may be changed without departing from the scope of the invention. Furthermore, the foregoing description is for the purpose of illustration only, and not for the purpose of limitation—the invention being defined by the claims.

What is claimed is:

1. A high efficiency process for the recovery of selected mineral particles from an ore utilizing a flotation column, the process comprising the steps of:

introducing a feed stream comprising a slurry of the ore into an upper portion of the flotation column wherein said mineral particles therein substantially range between about 20 mesh (840 microns) and about 325 mesh (44 microns) in size;

establishing and maintaining a net upward flow of water (negative bias) through a top portion of said flotation column between where the feed stream is introduced and the top of the flotation column, said net upward flow being maintained greater than zero but less than about 0.7 centimeters/second by introducing a selected flow of water at the top of said column and withdrawing a selected flow of pulp at the bottom of said column with substantially no water being added to the column below the location of the feed introduction;

establishing and maintaining an upwardly moving stream of diffuse air originating at a lower portion of said flotation column wherein said superficial air velocity is between about 0.5 and 2.0 centimeters/second;

establishing and maintaining the percent solids in said flotation column between about 35 and 50%;

establishing and maintaining column throughput of said slurry between about 1.8 and 4.0 tons/hour/square foot; and recovering said selected mineral particles from the top of said flotation column.

2. The process of claim 1 and further including adding between about 0.09 and 0.21 pounds/ton of primary amine into the flotation column feed stream to enhance said flotation column performance.

3. The process of claim 1 including selecting said ore from the group consisting of phosphate, quartz, lithium, feldspars and mica.

4. A high efficiency process for the recovery of selected mineral particles from an ore utilizing a flotation column, the process comprising the steps of:

introducing a fee stream comprising a slurry of the ore into an upper portion of the flotation column wherein the mineral particles therein substantially range between about 20 mesh (840 microns) and about 325 mesh (44 microns) in size;

establishing and maintaining a net upward flow of water (negative) bias through a top portion of said flotation column between where the feed stream is introduced and the top of the column, said net upward flow being maintained at a value of greater than zero and less than about 0.7 centimeters/second by introducing a selected flow of water at the top of said column and withdrawing a selected flow of pulp at the bottom of said column with substantially no water being added to the column below the location of the feed introduction;

establishing and maintaining an upwardly moving stream of diffuse air originating at a lower portion of said flotation column wherein said superficial air velocity is between about 0.5 and 2.0 centimeters/second;

establishing and maintaining the percent solids in said flotation column between about 35 and 50%;

establishing and maintaining column throughput of said slurry between about 1.8 and 4.0 tons/hour/square foot;

establishing and maintaining an overflow of wash medium at the top of said flotation column wherein said overflow does not exceed 0.6 centimeters/second; and recovering said selected mineral particles from the top of said flotation column.

5. The process of claim 4 and further including adding between about 0.09 and 0.21 pounds/ton of primary amine into the flotation column feed stream to enhance said flotation column performance.

6. The process of claim 4 including selecting said ore from the group consisting of phosphate, quartz, lithium, feldspars and mica.

* * * * *